US005315758A

United States Patent [19]

Ono et al.

[11] Patent Number: 5,315,758

[45] Date of Patent: May 31, 1994

[54] METHOD FOR MANUFACTURING SLIDE ELECTRICAL CONTACT

[75] Inventors: Yasuichi Ono; Akito Miura; Hirofumi Okumura, all of Miyagi, Japan

[73] Assignee: Alps Electric Co., Ltd., Tokyo, Japan

[21] Appl. No.: 64,299

[22] Filed: May 19, 1993

Related U.S. Application Data

[62] Division of Ser. No. 779,708, Oct. 21, 1991, abandoned.

[30] Foreign Application Priority Data

Oct. 31, 1990 [JP] Japan ..... 2-291791

[51] Int. Cl.[5] ..... H01R 43/20

[52] U.S. Cl. ..... 29/878; 29/826; 219/121.69; 219/121.66; 219/121.85

[58] Field of Search ..... 29/878, 874, 876, 825, 29/830; 219/121.63, 121.64, 121.65, 121.66; 228/179; 437/209

[56] References Cited

U.S. PATENT DOCUMENTS

| | | | |
|---|---|---|---|
| 1,723,915 | 8/1929 | Brown . | |
| 2,379,641 | 7/1945 | Keitel . | |
| 2,433,687 | 12/1947 | Durst . | |
| 3,164,708 | 1/1965 | Theobald . | |
| 3,258,830 | 7/1966 | Pityo . | |
| 3,641,298 | 2/1972 | Broverman . | |
| 3,733,573 | 5/1973 | Dietrich | 29/826 X |
| 3,735,079 | 5/1973 | Deiterich . | |
| 4,291,210 | 9/1981 | Wolber et al. . | |
| 4,345,372 | 8/1982 | Sekigawa et al. . | |
| 4,414,444 | 11/1983 | Schneider | 219/121.66 X |
| 4,430,635 | 2/1984 | Sacchetti . | |
| 4,642,891 | 2/1987 | Weik et al. . | |
| 4,777,720 | 10/1988 | Maier et al. | 29/826 |
| 4,832,798 | 5/1989 | Cvijanovich et al. | 219/121.66 X |
| 5,021,630 | 6/1991 | Benko et al. | 219/121.64 |
| 5,164,566 | 11/1992 | Spletter et al. | 219/121.63 |

FOREIGN PATENT DOCUMENTS

| | | | |
|---|---|---|---|
| 63-250141 | 10/1988 | Japan | 219/121.65 |
| 187626 | 12/1961 | Sweden . | |
| 781557 | 2/1956 | United Kingdom . | |
| 2169748 | 7/1986 | United Kingdom | 219/121.85 |

OTHER PUBLICATIONS

IBM Technical Disclosure Bulletin vol. 22 No. 2 Jul. 1979 p. 834 by Melcher.

*Primary Examiner*—Carl J. Arbes

*Attorney, Agent, or Firm*—Guy W. Shoup; Patrick T. Bever

[57] ABSTRACT

In a sliding contact having a base made of an elastic material and a precious metal contact connected to the base, the base extends along a sliding face, and the precious metal contact is connected to the base in the almost vertical direction with respect to the contact position of the precious metal contact and the sliding face by beam welding.

4 Claims, 5 Drawing Sheets

METHOD FOR MANUFACTURING SLIDE ELECTRICAL CONTACT

This application is a division of application Ser. No. 07/779,708, filed Oct. 21, 1991, now abandoned.

BACKGROUND OF THE INVENTION

1. Field of the Invention

The present invention relates to a sliding contact and a method of producing the contact.

2. Description of the Related Art

A well-known type of a sliding contact of an encoder for used in what is called a mouse and the like is shown in FIGS. 10(*a*) and 10(*b*). Such a sliding contact has a support 2 for moving above a resistor 1 (a pulse switch substrate may be used instead of the resistor) in the direction indicated by the arrow. A relatively wide base 3 made of an elastic material is supported by the support 2. The leading end of the base 3 is extended toward the resistor 1, and connected to an abrasive-resistant precious metal contact 4 in contact with the resistor 1 by, for example, welding. The precious metal contact 4 is formed by fixing fine wires 4*a*, each having a folded portion in contact with the resistor 1 at its end and a portion in contact with the base 3 at its other end, onto a linear plate 4*b* by electric resistance welding.

FIGS. 10(*c*) and 10(*d*) show another type of sliding contact having a construction which is basically similar to that of the contact shown in FIG. 10(*a*). In this case, the portion in contact with the resistor 1 is specially devised in its shape.

However, the above sliding contacts of the prior art have the following problems:

(1) Since the precious metal contact 4 has, at its end, the folded portion in contact with the resistor 1 and the fine wires are arranged in a row, the processing of the contact 4 is troublesome.

(2) The precious metal contact 4 needs a sufficient contact area in order to prevent the contact portion from falling due to the pressure when the other end of the precious metal contact 4 abuts against the resistor 1 located in the extending direction of the base 3. The length of the base 3 is thereby shortened. The base 3 is made of an elastic material, and the shortening of the base 3 hinders free deformation of the base 3, thereby making the pressure of the precious metal contact 4 against the resistor 1 unstable and lowering reliability of the precious metal contact 4.

(3) Since the precious metal contact 4 is formed with wires, there are many useless portions except for the contact point, and thus the cost is high. Furthermore, although the precious metal contact 4 is given a function for stabilizing the pressure by being made of an elastic precious metal and lengthened in order to solve the problem (2), the material of the contact 4 is limited to specific precious metals, and the amount of the used precious metal is increased, thereby increasing the cost.

(4) Since the assembling of the precious metal contact 4 and the connection of the precious metal contact 4 and the base 3 are performed by welding, the welding process takes much time. Furthermore, since the precious metal contact 4 is formed with wires as described above, it is necessary to take special trouble in positioning the precious metal contact 4 during the welding process.

SUMMARY OF THE INVENTION

An object of the present invention is to provide a sliding contact which stabilizes the pressure of a precious metal contact against a resistor, thereby enhances its reliability as a contact and reduces the cost.

Another object of the present invention is to provide a method of producing such a sliding contact in an extremely simple process.

In order to achieve the above objects, a sliding contact of the present invention is composed of a base made of an elastic material and a precious metal contact connected to the base. The base is extended along a sliding plane, and the precious metal contact is connected to the base in the almost vertical direction with respect to a contact position of the precious metal contact with the sliding plane.

In such a sliding contact, the base and the precious metal contact are connected to each other by beam welding.

As described above, since the base has an extended portion to slide on the surface of a resistor and the precious metal contact is formed in the extended portion of the base, the base is made longer than a conventional one, thereby obtaining a stable pressure against the resistor at its leading end, that is, a portion in contact with the precious metal contact. As a result, reliability of the sliding contact is improved. Furthermore, since it is not always necessary to make the precious metal contact from an elastic material, a wider choice of materials for the contact is possible, the contact performance is enhanced, and the cost is reduced.

The sliding contact having such construction can make the precious metal contact smaller in comparison with the base. Therefore, the precious metal contact needs not be in a special shape, and may be in a simple shape, for example, a sphere or a cube, thereby simplifying the processing of the precious metal contact and reducing the cost since the necessary amount of the precious metal is small.

Since the size of the precious metal contact can be small in comparison with that of the base, the close contact of the precious metal contact and the base can be easily performed by what is called beam welding, such as electronic beam welding or laser welding.

DESCRIPTION OF THE PREFERRED EMBODIMENTS

Figure 1A:
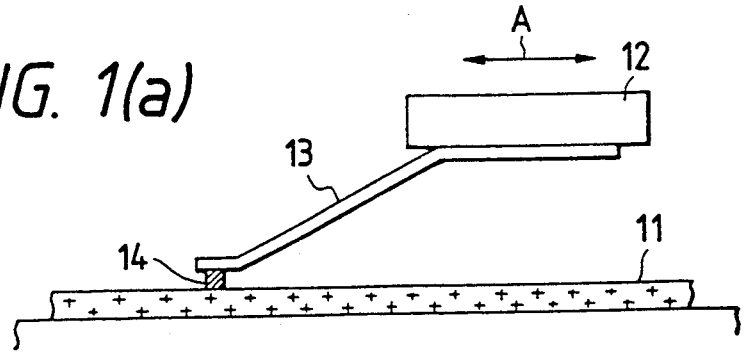
FIG. 1(*a*) and FIG. 1(*b*) are schematic views of an embodiment of a sliding contact according to the present invention.
Figure 1B:
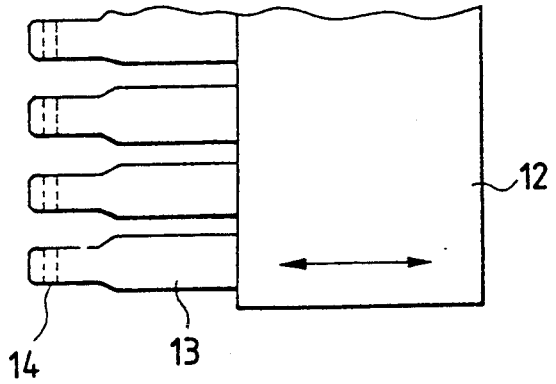

FIG. 1(*a*) and 1(*b*) are side and plan views of an embodiment of a sliding contact according to the present invention, respectively.

Referring to FIG. 1, a support 12 for moving parallel to a resistor 11 in the direction of the arrow A is placed above the resistor 11. A plurality of bases 13, each of which is extended toward the resistor, supported by the support 12 and made of an elastic material of, for example, nickel silver or phosphor bronze, are arranged in a row in the direction perpendicular to the moving direction of the support 12.

The leading end of the base 13 extends so as to slide on the main surface of the resistor 11.

A precious metal contact 14 is fixed to the leading end of the base 13, and slides on the resistor 11. As the precious metal contact, for example, a Pt or Pd precious metal is used.

In this embodiment, a portion of the base 13 where the precious metal contact 14 is fixed, that is, the leading end of the base 13 is bent to be parallel to the resistor 11 so that uniform pressure of the base 13 against the precious metal contact 14 is obtained.

Although it is feared that the base 13 is brought into contact with the resistor 11 since the base 13 is extended so as to slide on the resistor 11, in this case, the contact may be prevented by attaching a rib to the base 13.

In the sliding contact having such construction, since the base 13 is extended so as to slide on the resistor 11 and the extended portion is connected to the precious metal contact 14, the base 13 is made longer than a conventional one. Therefore, the pressure of the base 13 made of an elastic material against the resistor 11 can be stabilized in the leading portion of the base 13, that is, the portion where the precious metal contact 14 is fixed. This is because the portions 3 and 4 of the prior art for generating pressure are replaced with the base 13 which does not have unstable welded portions. Therefore, it is possible to stabilize the pressure of the precious metal contact 14 against the resistor 11 and thus to improve reliability of the sliding contact.

Figure 2:
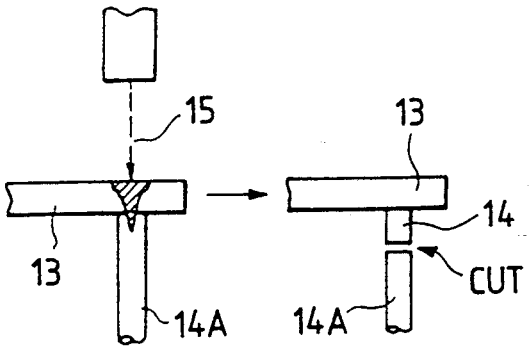
FIG. 2 is a schematic view explaining an embodiment of a method of producing the sliding contact according to the present invention.

FIG. 2 shows a method of fixing the base 13 and the precious metal contact 14. While one end of a precious metal material 14A made of a wire is in contact with one side of the base 13, What is called beam welding is performed by radiating YAG laser light 15 onto the base 13 from the other side of the base 13. Then, a part of the precious metal material 14A having an appropriate length is cut off, and the left part of the precious metal material 14A connected to the base 13 is used as a precious metal contact 14.

Since the base 13 and the precious metal contact 14 are connected as described above, the precious metal contact 14 can be extremely small with respect to the base 13. In such a case, beam welding is effective.

Figure 3:
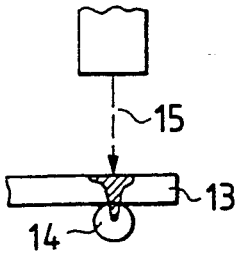
FIG. 3 is a schematic view explaining another embodiment of a method of producing the sliding contact according to the present invention.

Although the precious metal contact 14 is shaped by cutting a part having an appropriate length from the precious metal wire in the description shown in FIG. 2, it may be spherical as shown in FIG. 3. In this case, various kinds of advantages can be obtained in the production process.

Figure 4:
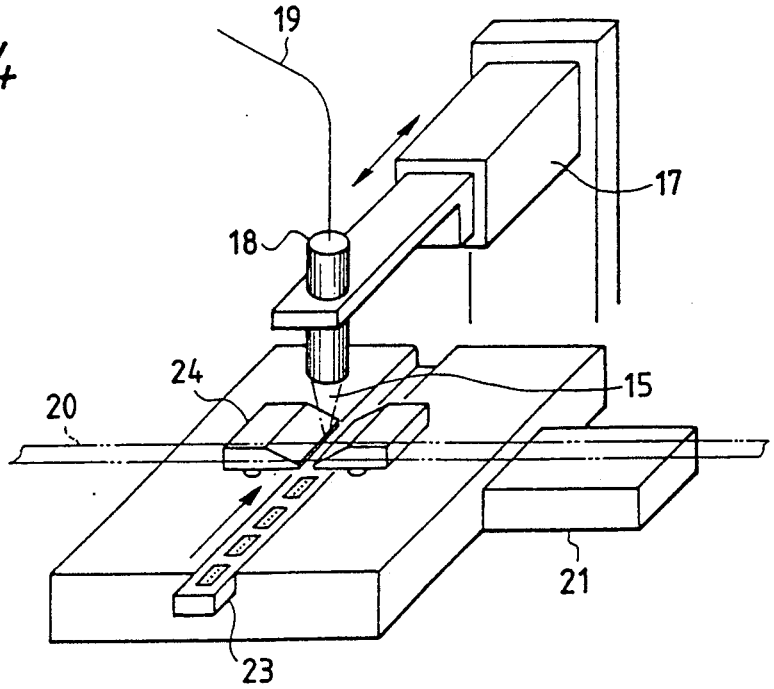
FIG. 4 is a schematic view of an embodiment of a welding device used in the production method shown in FIG. 3.
Figure 5A:
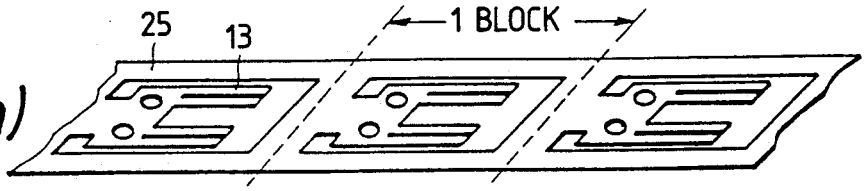
FIGS. 5(*a*), 5(*b*) and 5(*c*) are explanatory views of an embodiment of an operation of a welding device shown in FIG. 4.
Figure 5B:
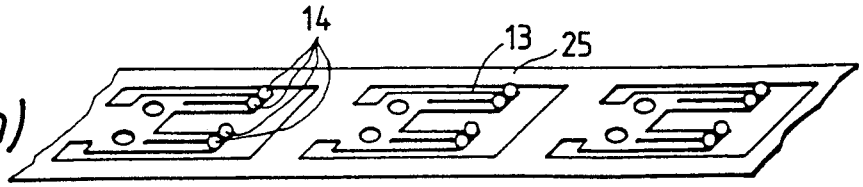
Figure 5C:
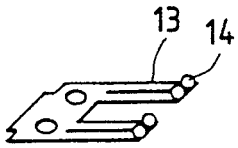

The method of producing the sliding contact will now be described. FIG. 4 shows a beam welding device, and more particularly, a laser beam welding device. A radiation unit 18 is mounted in a single axis positioner 17 so as to radiate YAG laser light 15 through an optical fiber 19. A slider strip hoop 20 is intermittently moved in a portion where the YAG laser light 15 is radiated. As shown in FIG. 5(*a*), the slider strip hoop 20 is formed of a plurality of blocks, in each of which the base 15 and a frame 25 are processed as a unit, arranged in a line in the moving direction of the slider strip hoop 20. The intermittent movement of the slider strip hoop 20 is carried out by a tension feeder 21.

A contact material feeding mechanism 23 intermittently moves perpendicular to the slider strip hoop 20 toward the portion irradiated by the YAG laser 15. Precious metal contacts 14 (spherical) necessary for one block of the slider strip hoop 20 are positioned on the contact material feeding mechanism 23, and intermittently fed one by one.

In other words, each precious metal contact 14 in the slider strip hoop 20 is clamped by a clamper 24, and connected to the leading end of the base 13 by beam welding as shown in FIG. 5(*b*).

Subsequently, as shown in FIG. 5(*c*), the frame 25 is cut off, so that the base 13 in close contact with the precious metal contacts 14 to be attached to the support 12 later is obtained.

Figure 6A:
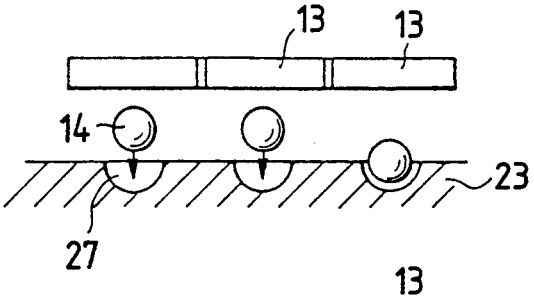
FIGS. 6(*a*), 6(*b*) and 6(*c*) are explanatory views of an embodiment of a positioning means for a precious contact in the welding device shown in FIG. 4.
Figure 6B:
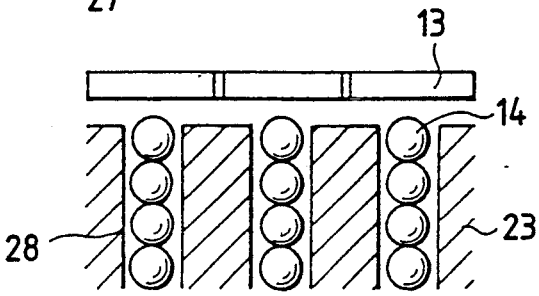
Figure 6C:
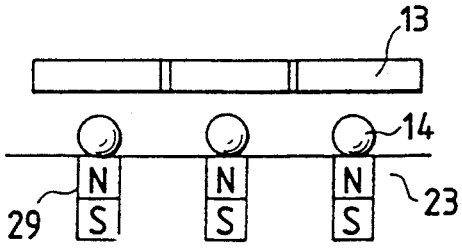

The positioning mechanism for the precious metal contacts 14 in the contact material feeding mechanism 23 in the embodiment shown in FIG. 4 will now be described. As shown in FIG. 6(*a*), the contact material feeding mechanism 23 has hemispherical concave portions 27 in each of which the spherical precious metal contact 14 is contained. The concave portions 27 are each located below each base 13 (of the slider strip hoop 20).

Both the slider strip hoop 20 and the contact material feeding mechanism 23 are intermittently moved in the case shown in FIG. 6(*a*). However, as shown in FIG. 6(*b*), if holes 28 are formed in the contact material feeding mechanism 23 and a plurality of precious metal contacts 14 are contained in each of the hole 28, the slider strip hoop 20 is fed in several steps (corresponding to the number of the precious metal contacts 14 in the hole 28) during one step of the contact material feeding mechanism 23 by urging the precious metal contact 14 upward by a spring (not shown) placed at the bottom of the hole 28.

It is needless to say that a special mechanism may be mounted at the bottom of the hole 28 so as to continuously supply the precious metal contacts 14 from the bottom of the hole to the bases 13.

Although the precious metal contacts 14 are positioned by the concave portions 27 or the holes 28 in the contact material feeding mechanism 23 in the cases shown in FIGS. 6(*a*) and 6(*b*), the present invention is not limited to the above cases and may be as shown in FIG. 6(*c*). In FIG. 6(*c*), magnets 29 are embedded in the upper face of the contact material feeding mechanism 23 and the precious metal contacts 14 are positioned by attraction of the magnets 29.

Figure 7A:
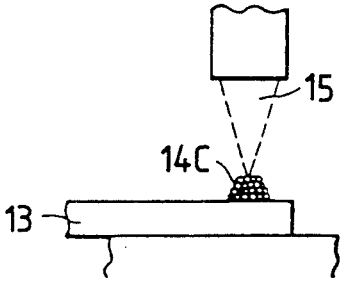
FIGS. 7(*a*), 7(*b*) and 7(*c*) are schematic views showing a further embodiment of a method of producing a sliding contact according to the present invention.
Figure 7B:
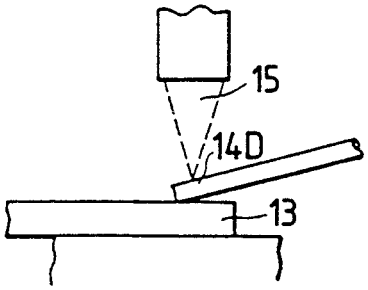
Figure 7C:
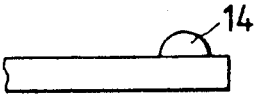

Although the precious metal contact 14 connected to the base 13 is shaped as a contact before the connection in the above embodiments, the present invention is limited to the embodiments. For example, as shown in FIGS. 7(*a*) and 7(*b*), a powdered material 14*c* made of a precious metal is placed on the base 13, the YAG laser light 15 is radiated onto the powdered material 14*c* and a hemispherical precious metal contact 14 is formed by using the surface tension arising from the melting of the powdered material 14*c*, or a wire 14D made of a precious metal is brought close to the base 13 and the hemispherical precious metal contact 14 is formed by using the surface tension arising from the melting of the wire 14D by the YAG laser light 15.

Figure 8A:
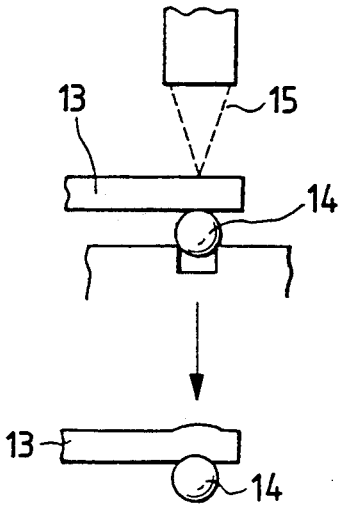
FIGS. 8(*a*) and 8(*b*) are schematic views showing a still further embodiment of a method of producing the sliding contact according to the present invention.
Figure 8B:
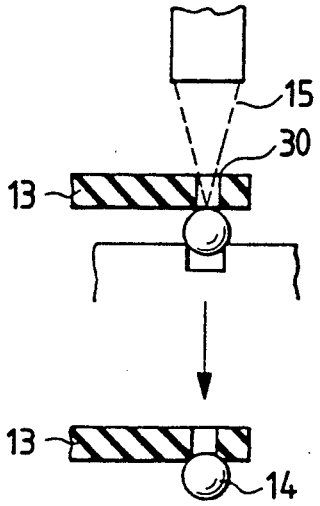

Although the contact portion of the base 13 to which the precious metal contact 14 is connected is flat as shown in FIG. 8(*a*) in the above embodiments, it may have a hole 30 as shown in FIG. 8(*b*). In this case, since the base 13 with the precious metal contact 14 is enlarged, reliability of welding is improved.

Figure 9:
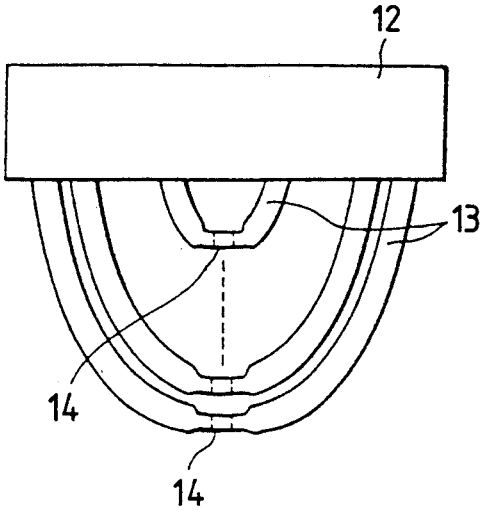
FIG. 9 is a schematic view of another embodiment of a sliding contact according to the present invention.
Figure 10A:
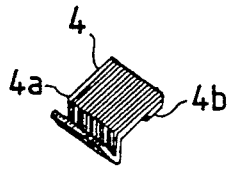
FIG. 10(a) PRIOR ART
FIGS. 10(*a*), 10(*b*), 10(*c*) and 10(*d*) are schematic views of conventional sliding contacts.
Figure 10B:
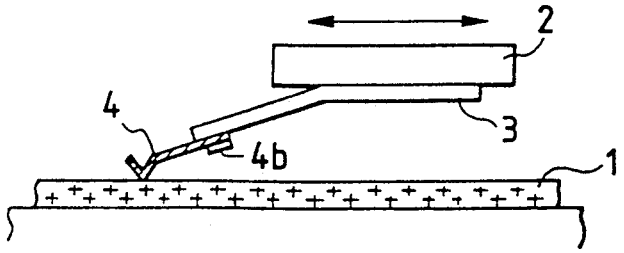
FIG. 10(b) PRIOR ART
Figure 10C:
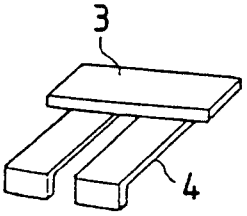
FIG. 10(c) PRIOR ART
Figure 10D:
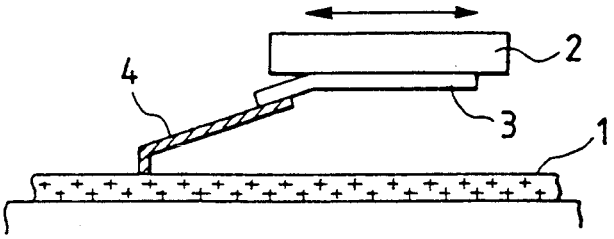
FIG. 10(d) PRIOR ART

Furthermore, although the base 13 is supported by the support 12 at its one end in the above embodiments, both ends of the base 13 may be supported by the support 12 as shown in FIG. 9. In this case, the supporting force between the base 13 and the support 12 is increased.

According to the above embodiments, the limit on the material for the precious metal contact, which has needed elasticity, is eliminated by this method, and other precious metals and contact materials having excellent abrasion and corrosion resistance may be used.

As described above, according to a sliding contact of the present invention, it is possible to stabilize the pressure of the precious metal contact against the resistor, to enhance reliability of the sliding contact, and to reduce the cost.

Furthermore, according to a method of producing a sliding contact of the present invention, the sliding contact can be produced in an extremely simple process.

What is claimed is:

1. A method for manufacturing a sliding electrical contact comprising the steps of:

machining a resilient plate-like metallic material to provide a base material;

mounting a precious metal contact on a flat surface of said base; and directing a laser beam at a second surface opposite to the first surface of said base to connect said precious metal contact to said base;

wherein a section of a wire forms the precious metal contact.

2. A method for manufacturing a sliding electrical contact comprising the steps of:

machining a resilient plate-like metallic material to provide a base;

mounting a precious metal contact on a first surface of said base material; and directly bonding said precious metal contact to said base by directing a laser beam at a second surface opposite to the first surface of said base.

3. A method for manufacturing a sliding electrical contact as set forth in claim 2 wherein the precious metal contact has a spherical shape.

4. A method for manufacturing a sliding electrical contact as set forth in claim 2 wherein the precious metal contact on the surface of the base material is mounted at an extreme end of the base material.

* * * * *